US006893387B1

(12) United States Patent
Dahlquist

(10) Patent No.: US 6,893,387 B1
(45) Date of Patent: May 17, 2005

(54) MAILING ENVELOPE ASSEMBLY

(75) Inventor: Ake L. Dahlquist, Dixon, IL (US)

(73) Assignee: Sleepeck Printing Company, Dixon, IL (US)

( * ) Notice: Subject to any disclaimer, the term of this patent is extended or adjusted under 35 U.S.C. 154(b) by 0 days.

(21) Appl. No.: 10/417,059

(22) Filed: Apr. 16, 2003

(51) Int. Cl.[7] ..... B31B 1/90
(52) U.S. Cl. ..... 493/216; 53/460
(58) Field of Search ..... 493/216, 186, 493/231, 243; 53/460

(56) References Cited

U.S. PATENT DOCUMENTS

| | | | | | |
|---|---|---|---|---|---|
| 3,902,655 | A | | 9/1975 | Huffman | |
| 3,955,750 | A | | 5/1976 | Huffman | |
| 3,968,927 | A | | 7/1976 | Katz et al. | |
| 4,002,290 | A | | 1/1977 | Van Malderghem | |
| 4,010,889 | A | | 3/1977 | Allen et al. | |
| 4,063,398 | A | | 12/1977 | Huffman | |
| 4,201,332 | A | | 5/1980 | Wooten | |
| 4,277,016 | A | | 7/1981 | Wakeman et al. | |
| 4,305,506 | A | * | 12/1981 | Greenwald | 229/305 |
| 4,543,082 | A | * | 9/1985 | Stenner | 493/216 |
| 4,586,611 | A | | 5/1986 | Scalzo | |
| 4,676,526 | A | | 6/1987 | Redman | |
| 4,912,909 | A | * | 4/1990 | Stenner | 53/429 |
| 4,993,624 | A | | 2/1991 | Schlich | |
| 5,087,805 | A | | 2/1992 | Silverschotz et al. | |
| 5,125,562 | A | | 6/1992 | Bendel | |
| 5,137,304 | A | | 8/1992 | Silverschotz et al. | |
| 5,224,647 | A | | 7/1993 | Yanow | |
| 5,277,362 | A | | 1/1994 | Wilson | |
| 5,370,304 | A | | 12/1994 | Sauerwine et al. | |
| 5,400,957 | A | | 3/1995 | Stude | |
| 5,415,341 | A | | 5/1995 | Diamond | |
| 5,467,917 | A | | 11/1995 | Potter | |
| 5,640,835 | A | | 6/1997 | Muscoplat | |
| 5,713,511 | A | | 2/1998 | Diamond | |
| 5,803,889 | A | * | 9/1998 | Littman | 493/267 |
| 5,865,717 | A | * | 2/1999 | Fabel | 493/216 |
| 5,904,030 | A | * | 5/1999 | Kavanagh | 53/460 |
| 5,997,457 | A | * | 12/1999 | Stenner | 493/216 |
| 6,003,760 | A | | 12/1999 | Abercrombie | |
| 6,053,855 | A | * | 4/2000 | Stenner | 493/216 |
| 6,065,778 | A | | 5/2000 | Dovel et al. | |
| 6,080,094 | A | * | 6/2000 | Dahlquist | 493/216 |
| 6,129,264 | A | | 10/2000 | Travers et al. | |
| 6,478,723 | B1 | * | 11/2002 | Travers et al. | 493/187 |

* cited by examiner

*Primary Examiner*—Eugene Kim
(74) *Attorney, Agent, or Firm*—Ryndak & Suri

(57) ABSTRACT

A mailing envelope assembly is disclosed. The assembly includes a sealed outer envelope. The assembly further includes an inner envelope contained within the outer envelope. The inner envelope has a flap, closed ends and an interior portion. The interior portion has an interior longitudinal length and an interior transverse width. The assembly still further includes a foldable insert that is contained and oriented within the outer envelope. The insert typically has a longitudinal length as contained in the outer envelope that is greater than the interior longitudinal length of the inner envelope. The longitudinal length of the insert as contained in the outer envelope is no greater than twice the interior transverse width of the inner envelope. The insert also has a longitudinal length as contained in the outer envelope that is no greater than twice the interior or usable transverse width of the interior portion of the inner envelope, so that when the insert is transversely folded in half and rotated 90° relative to the orientation of the insert as contained in the outer envelope, the folded insert fits within the interior portion of the inner envelope.

22 Claims, 5 Drawing Sheets

MAILING ENVELOPE ASSEMBLY

TECHNICAL FIELD

The present invention relates to a mailing envelope assembly that is particularly suitable for mass mailings. More particularly, the present invention relates to a mailing envelope assembly with a sealed outer envelope, an inner envelope and an insert, with both the inner envelope and insert contained within the sealed outer envelope.

BACKGROUND OF THE INVENTION

A need exists for a mailing envelope assembly product that can be suitable for mass mailings and that qualifies for and can meet the United States Postal regulations for automated bulk or minimum mailing rates. A need exists for a mailing envelope assembly that qualifies for, for example, but is not limited to, "automated mail" and "letter size" regulations.

Businesses that send mailing envelope assemblies typically desire to obtain a response from the recipients. Recipients, on the other hand, often do not wish to be bothered by mail solicitations. In order to achieve a higher probability that recipients of mailing envelope assemblies will respond to the enclosed surveys or other enclosed matter, the mail assembly should not require a complicated response method that includes a manifold amount of or complex steps. A need exists for a mailing envelope assembly that can be suitable for mass mailings and that encourages a higher response rate from recipients. Specifically, a need exists for a mailing envelope assembly that provides an arrangement that makes it easy and convenient for a recipient to respond.

The manufacture of standard mailing envelope assemblies can be capital intensive from an equipment acquisition standpoint and often produces a higher amount of waste than desired. A need exists for a mailing envelope assembly that is manufactured economically and at a high rate of production and with a process that eliminates material waste and the requirement of expensive and special equipment.

SUMMARY OF THE INVENTION

In accordance with one aspect of the present invention, a mailing envelope assembly is provided that includes a foldable insert that fits into an inner envelope after it is transversely folded in half and rotated 90° relative to its orientation as contained in an outer envelope. The assembly includes an outer envelope that typically will be sealed and an inner envelope and foldable insert contained within the outer envelope. The inner envelope typically has a flap, closed ends and an interior portion that has an interior or usable longitudinal length and an interior or usable transverse width. The foldable insert is contained within the outer envelope, typically in a desired orientation, and typically has a longitudinal length as contained in the outer envelope that is greater than the interior longitudinal length (i.e., the usable longitudinal interior) of the inner envelope, the longitudinal length of the insert as contained in the outer envelope being no greater than twice the interior or usable transverse width of the inner envelope and the insert having a transverse width as contained in the outer envelope that is no greater than the interior longitudinal length of the interior portion of the inner envelope. The foregoing relationships of the insert and inner envelope allow the insert to fit inside the inner envelope after it is transversely folded in half and rotated 90°.

In accordance with another aspect of the invention, in a preferred embodiment, the outer envelope includes a flap, which further includes adhesive material. The adhesive material is used to seal the outer envelope. In a preferred embodiment, the outer envelope has an open end or ends and the inner envelope and insert are retained therein by suitable structure, which could be, for example, attachment to the outer envelope.

In accordance with another aspect of the invention, the outer envelope, inner envelope and insert have longitudinal lengths that are substantially the same.

In accordance with another aspect of the invention, in one embodiment, the outer envelope has an open end or ends and the inner envelope is retained within the outer envelope by a friction-fit. A friction fit is the result of a frictional engagement created by the similar but slightly larger transverse width of the outer envelope relative to the inner envelope and/or the insert as contained in the outer envelope. Frictional engagement is resistance to sliding motion or longitudinal movement relative to the outer envelope and the insert and/or inner envelope. The similar transverse dimensions as described of the inner envelope and/or insert and outer envelope provides resistance to relative movement causing the inner envelope and insert to be restrained from removal through the open end or ends of the outer envelope so that the contents of the outer envelope remain inside the outer envelope. In accordance with another aspect of the invention, the insert may also be retained within the outer envelope by a friction fit.

In accordance with another aspect of the invention, in one embodiment, the inner envelope and/or the insert may be attached to the outer envelope. In another embodiment, the inner envelope and/or the insert is attached to the outer envelope, preferably along a longitudinal line of weakening to readily permit separation of the inner envelope from the outer envelope. In the foregoing embodiments, the inner envelope and the insert may be attached to each other, preferably along a line of weakening. In a preferred embodiment, the line of weakening is a line of perforations.

In accordance with another aspect of the invention, in an alternate embodiment, the inner envelope is retained within the outer envelope by an adhesive. Preferably, in this embodiment, the adhesive is a spot of adhesive, glue material or another material or structure that performs a similar function, that retains the inner envelope and/or the insert in a fixed relation to and within the outer envelope.

In accordance with another aspect of the invention, in one embodiment, the inner envelope is contained or partially contained within the insert. In an alternate embodiment, the insert is contained or partially contained within the inner envelope.

In accordance with another aspect of the invention, the insert is a survey form that includes instructions for a recipient to complete. The instructions may be in the form of printed matter or other indicia, which may also be printed. Alternately, the insert may be an order form, questionnaire, coupons, a brochure, advertising or any other direct mail marketing or other material as known in the art or as otherwise desired.

In accordance with another aspect of the invention, a method of conducting a survey is provided. The method includes mailing the mailing envelope assembly of the present invention to a recipient. The insert of the assembly is a survey form that includes instructions for a recipient to complete. The method further includes receiving the completed survey form from the recipient contained in the inner envelope.

Numerous advantages may be realized by the present invention. An assembly in accordance with the invention includes all components that a recipient needs to respond to the sender, including the inner return envelope, which can include return postage. The assembly of the present invention makes it easy and convenient for a recipient to respond and therefore provides for a potential of an increased response rate.

In addition, the assembly can be designed and sized so that it satisfies the low bulk rate mailing requirements for bulk mail.

In addition, the outer envelope, inner envelope and/or insert can be constructed to have frictional resistance to relative movement that prevents or restrains removal of the contents of the outer envelope until desired. Because of this frictional engagement, the outer envelope may have an open transverse end or ends. An outer envelope with open transverse ends is simpler and less expensive to manufacture than one with closed ends or other envelopes.

In accordance with the present invention, a method of making a mailing envelope assembly is provided. In accordance with the method of the invention, envelopes are made from a web of material. "Web" means an elongated strip of thin, flexible material (for example, paper), which may be obtained from a roll or any suitable source, for example.

Preferably, the methods of the present invention are practiced using web handling and/or web printing equipment. Such equipment is well known in the web printing and web handling art and is used to perform various operations on a web or webs of material including, but not limited to, conveying, printing, folding, gluing and cutting, for example. The methods in accordance with the invention permit the entire envelope assembly to be made during one production run set-up and at the same time without the need for any manual assembly or separate insertion of the inner envelope or insert inside the outer envelope.

In accordance with one aspect of the invention, a method of making a mailing envelope assembly of the type previously described is provided. The elements or steps of the methods of the invention generally do not require any particular order as will be known by one skilled in the art or unless otherwise specified. A method includes folding a web to define a longitudinal web region from which the inner envelope is formed. Adhesive material is applied (which may be spine glue) transversely to a surface of the web at spaced transverse intervals in a location for the inner envelope portion. Thereafter, the web is longitudinally folded so that the adhesive material attaches the web at the spaced intervals to form the inner envelope portion. Adhesive material is applied (which typically will be remoistenable adhesive) longitudinally on the surface of the web or to a different web for an inner envelope flap adhesive and thereafter the web is longitudinally folded to form the inner envelope flap adjacent or generally adjacent as desired to the flap adhesion, typically after the adhesive has dried.

The web is longitudinally folded in a web region not occupied by the inner envelope to form the insert portion. The web may be folded one or more times to form two or more panels, as desired. The method further includes forming a line of weakening longitudinally on the web adjacent or generally adjacent as desired to the transversely applied adhesive material to allow subsequent separation of the inner envelope from either the insert or outer envelope. The line of weakening may be a line of perforations or a score line that weakens the web along the line and can be more easily separated or removed. Preferably, the line of weakening is a line of perforations.

The web is longitudinally folded to form an outer envelope panel, and the outer envelope and optionally applying adhesive material (which may be remoistenable adhesive) longitudinally on a region of the web that will form the outer envelope flap.

Preferably, when the outer envelope is formed from a web that is also used to form the inner envelope or the insert, the method includes forming a line of weakening longitudinally on the web adjacent to the panel that will become the outer envelope. The line of weakening may be a line of perforations or a score line that weakens the web along the line and can be more easily separated or removed. Preferably, the line of weakening is a line of perforations.

The method also includes longitudinally folding the outer envelope web region to form the outer envelope and outer envelope flap (if an outer envelope flap is to be present), in which the outer envelope encloses the inner envelope and the insert portion. In a preferred embodiment, adhesive material (which may be pressure-sensitive, resealable adhesive) is applied to the envelope flap. If any of the components, such as the inner envelope, insert or outer envelope are formed from separate webs, the separate webs need to be in or brought into appropriate registry for further processing and/or assembly into the product as previously described and generally prior to transverse cutting into individual mailing assemblies.

In accordance with another aspect of the invention, the method includes transversely cutting the web or webs to form the individual mailing envelope assemblies previously described. It is to be understood that one or more or each of the outer envelope, inner envelope and insert can be made from separate webs or from the same web and the foregoing description is intended to cover all such variations.

DETAILED DESCRIPTION OF THE INVENTION

Figure 1:
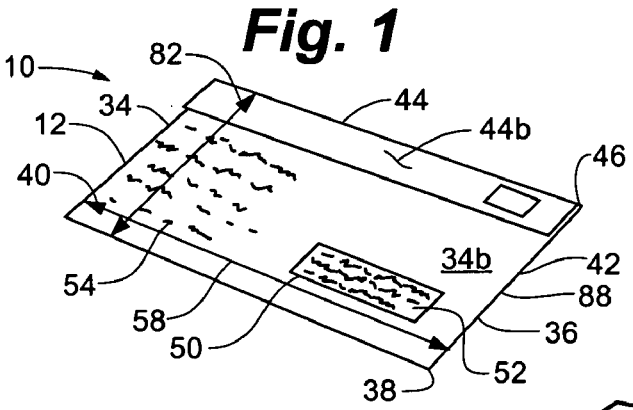
FIG. 1 illustrates a perspective view of a mailing envelope assembly in accordance with the present invention.
Figure 2:
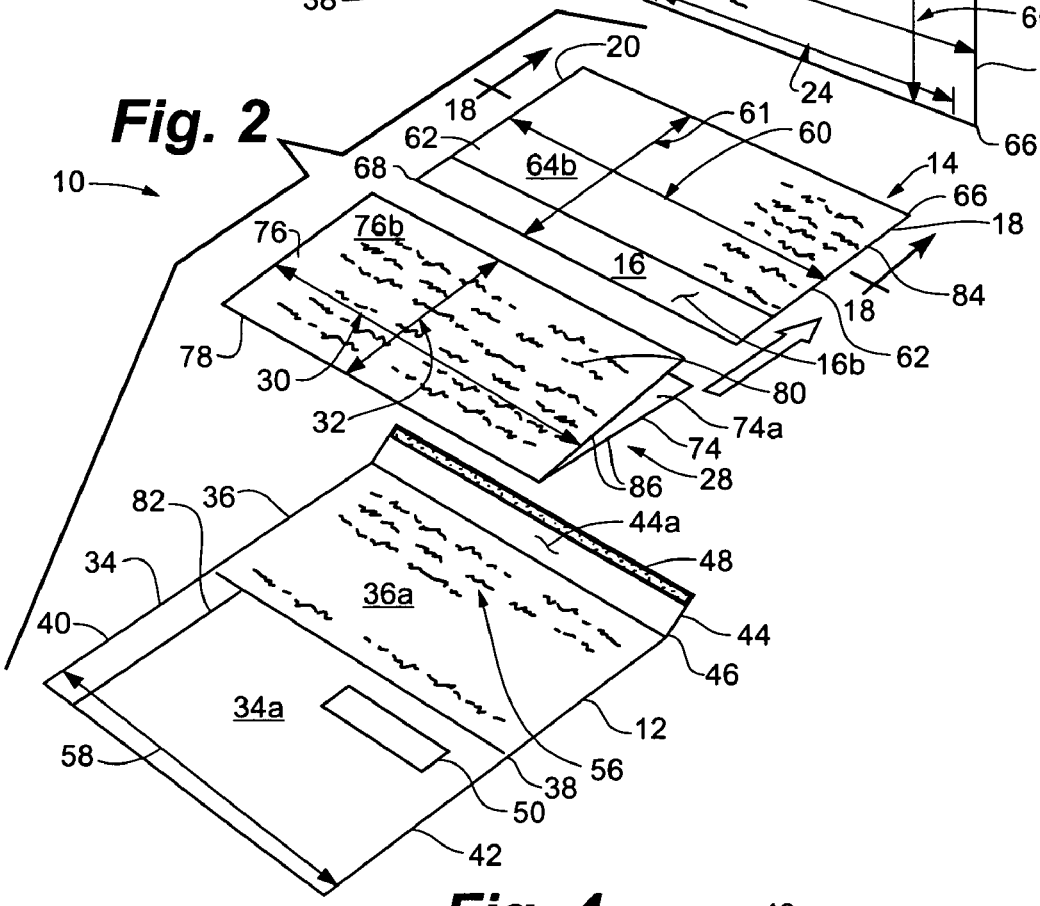
FIG. 2 illustrates a perspective view of an insert and an inner envelope that are removed from the outer envelope of the assembly of FIG. 1.

Referring to the Figures generally, and in particular to FIGS. 1–4, where like reference numerals denote like elements, there is illustrated a mailing envelope assembly 10 in accordance with the invention. Assembly 10 includes an outer envelope 12 that is sealed. Assembly 10 also includes an inner envelope 14 that is contained within outer envelope 12. Inner envelope 14 has a flap 16, closed transverse ends 18 and 20 and an interior portion 22. Interior portion 22 has an interior or usable longitudinal length 24 and an interior or usable transverse width 26. Assembly 10 further includes a foldable insert 28 that is contained and oriented within outer envelope 12 as illustrated in FIG. 2. Insert 28 may be composed of one, two (as illustrated) or more panels and has a longitudinal length 30 as contained in outer envelope 12 that is greater than interior longitudinal length (i.e., usable longitudinal length) 24 of inner envelope 14 and no greater than twice the interior or usable width 26 of inner envelope 14. Insert 28 also has a transverse width 32 as contained in outer envelope 12 that is no greater than the interior longitudinal length 24 of interior portion 22 of inner envelope 14. Thus, when insert 28 is folded in half and rotated 90° relative to the orientation of insert 28 as contained in outer envelope 12, the folded insert 28 can be inserted in the direction of arrow B in FIG. 3 and fits within interior portion 22 of inner envelope 14.

Outer envelope 12 further includes a front panel 34 and a rear panel 36, formed by fold 38, as illustrated in FIGS. 1 and 2, and each of front and rear panels 34 and 36 has an interior surface 34*a* and 36*a* and an exterior surface 34*b* and 36*b*, respectively. In a preferred embodiment, outer envelope 12 has open transverse ends 40 and 42, as best illustrated in FIGS. 1 and 2.

In a preferred embodiment, outer envelope 12 further includes a flap 44. Flap 44 is formed by a fold 46 and includes an interior surface 44*a* and an exterior surface 44*b*. Flap 40 further includes adhesive material 48 on interior surface 44*a*, as illustrated in FIG. 2. In one embodiment, adhesive material 48 is a continuous strip, as illustrated in FIG. 2. Alternately, adhesive material 48 may be discontinuous (not shown). In one embodiment, adhesive material 48 is pressure-sensitive material. In an alternate embodiment, adhesive material 48 is remoistenable adhesive, either water or solvent based. Alternately, adhesive material 48 may be any adhesive as known in the art. Adhesive material 48 on interior surface 44*a* of flap 44 adheres to exterior surface 34*b* of front panel 34 and thus seals outer envelope 12 and assembly 10 as a whole, as illustrated in FIG. 1.

Outer envelope 12 may include a die cut window 50 on front panel 34 that displays a mailing address 52 of a recipient of assembly 10, as illustrated in FIG. 1. Alternately, the mailing address 52 may be printed, written on or applied to exterior surface 34*b* in any manner as known in the art. Outer envelope 12 may further include indicia 54 and 56 on exterior surface 34*b* and interior surface 36*a*, respectively, as illustrated in FIGS. 1 and 2. In one embodiment, indicia 54 and 56 may be human readable and may include instructions for a recipient for filling out and returning assembly 10 to sender. Alternately, indicia 54 and 56 may be other human readable indicia or non-human readable indicia including, but not limited to, symbols, images, bar codes or trademarks, for example.

In a preferred embodiment, outer envelope 12, inner envelope 14 and insert 28 have longitudinal lengths 58, 60 and 30, respectively, which are substantially the same. In sealed assembly 10, the similar transverse widths 82, 61 and 32 create a frictional resistance to relative movement between outer envelope 12 and inner envelope 14 and/or insert 28, respectively. Frictional resistance to relative movement generally is resistance to sliding movement relative to two surfaces in contact. Typically, transverse width 82 will be slightly greater than transverse widths 61 and 32 to allow the desired frictional engagement between outer envelope 12 and inner envelope 14 and/or insert 28 and to permit inner envelope 14 and insert 28 to be contained within outer envelope 12 without binding, folding or pinching of inner envelope 14 and/or insert 28. Typically, outer envelope width 82 will be in the range of 0.01 to 0.125 inches greater than the width of inner envelope 14 and/or insert 28 to achieve the foregoing frictional fit while permitting inner envelope 14 and insert 28 to be suitably contained therein. Thus, outer envelope 12, inner envelope 14 and/or insert 28 remain in place and are retained in assembly 10 by a friction fit. Because of the frictional engagement exhibited by the contents of assembly 10, including inner envelope 14 and insert 28, outer envelope 12 may have open transverse ends 40 and 42 without the requirement for other structure, such as interconnection or glue between outer envelope 12 and inner envelope 14 and/or insert 28. An outer envelope 12 with open transverse ends 40 and 42 is simpler and less expensive to manufacture and weighs less, and therefore will help qualify assembly 10 for a low bulk rate for automated mailing.

Inner envelope 14 further includes a front panel 62 and a rear panel 64, formed by fold 66. Both front and rear panels 62 and 64, respectively, have interior and exterior surfaces 62*a*, 64*a* and 62*b*, 64*b*, respectively. Interior surfaces 62*a* and 64*a* form interior portion 22. Flap 16 is formed by fold 68 and further includes an interior surface 16*a* and an exterior surface 16*b*.

Figure 3:
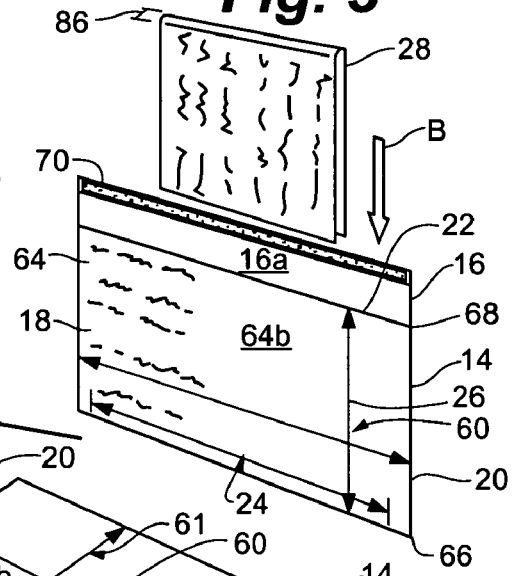
FIG. 3 illustrates a perspective view of the insert of FIG. 2 that is folded and rotated and being inserted into the inner envelope of FIG. 2.

Adhesive material 70 is located on interior surface 16*a* of flap 16. In one embodiment, adhesive material 70 is a continuous strip, as illustrated in FIG. 3. In an alternate embodiment, adhesive material 70 is discontinuous (not shown). In one embodiment, adhesive material 70 is pressure-sensitive material. In an alternate embodiment, adhesive material 70 is remoistenable adhesive. Alternately, adhesive material 70 may be any adhesive as known in the art. Upon activation, adhesive material 70 of interior surface 16*a* adheres to exterior surface 64*b* of rear panel 64 and thus seals inner envelope 14.

Figure 18:
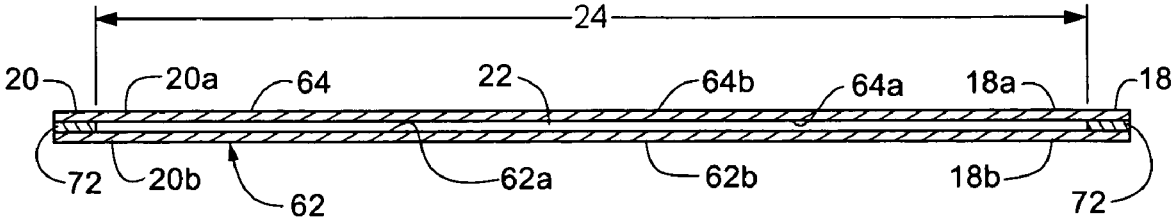
FIG. 18 illustrates a sectional view along line 18—18 of FIG. 2.

Inner envelope 14 also typically will include adhesive material 72, which may be glue, along inner transverse edges 18*a*, 18*b* and 20*a*, 20*b* of ends 18 and 20, as illustrated in FIG. 18. The adhesive material 72 defines interior portion 22 and seals closed transverse ends 18 and 20. The adhesive material 72 may be any adhesive material as known in the art.

In a preferred embodiment, insert 28 has multiple panels 74 and 76 that are foldable and are formed by fold 78, as illustrated in FIG. 2. Panels 74 and 76 have interior surfaces, 74*a* and 76*a*, respectively, and exterior surfaces 74*b* and 76*b*, respectively. Alternately, insert 28 may have a single panel (not shown). Insert 28 includes indicia 80, which preferably is human readable. Insert 28 may be a survey, order form, questionnaire, coupons, a brochure, advertising or any other direct mail marketing or other material as known in the art. Indicia 80 may include instructions for a recipient to complete the contained insert 28 and further return insert 28 inside inner envelope 14 to sender.

In one preferred embodiment, the minimum transverse width 82 (or height) of outer envelope 12 is about 3.5 inches and the minimum longitudinal length 58 of outer envelope 12 is about 6 inches. The width 84 of inner envelope 14 and the width 86 of insert 28 are only about 1/16 inch, less than the width 88 of outer envelope 12. Because of these dimensions, assembly 10 may qualify for bulk postage rates.

To open sealed assembly 10, a recipient opens flap 44 of outer envelope 12. Then, front panel 34 is opened, displaying both insert 28 and inner envelope 14, as illustrated in FIG. 2. After recipient has followed directions as to completing and returning insert 28 to sender, insert 28 is folded in half along fold 78, rotated 90° relative to the orientation of insert 28 as contained in outer envelope 12 and inserted into interior portion 22 of inner envelope 14, as illustrated in FIG. 3. Adhesive material 70 on flap 16 of inner envelope 14 may then be activated and flap 16 may be folded along fold 68 and interior surface 16*a* of flap 16 may be adhered to exterior surface 64*b* of rear panel 64, thus sealing inner envelope 14.

Figure 4:
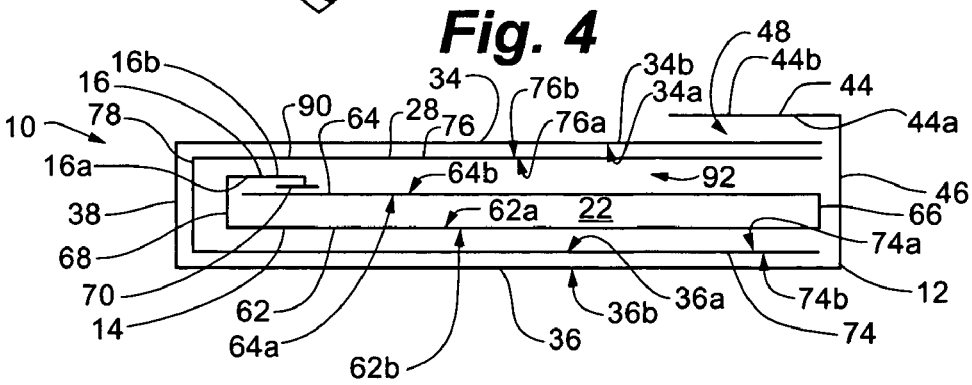
FIG. 4 illustrates a schematic, transverse sectional view of the assembly of FIG. 1.
Figure 5:
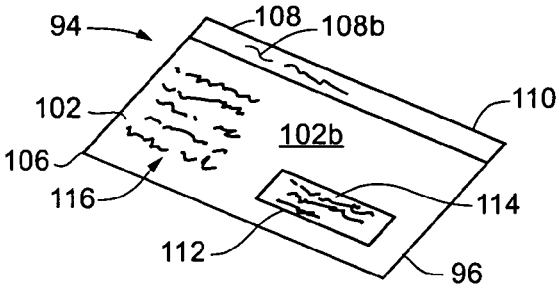
FIG. 5 illustrates a perspective view of an alternate embodiment of a mailing envelope assembly in accordance with the present invention.
Figure 6:
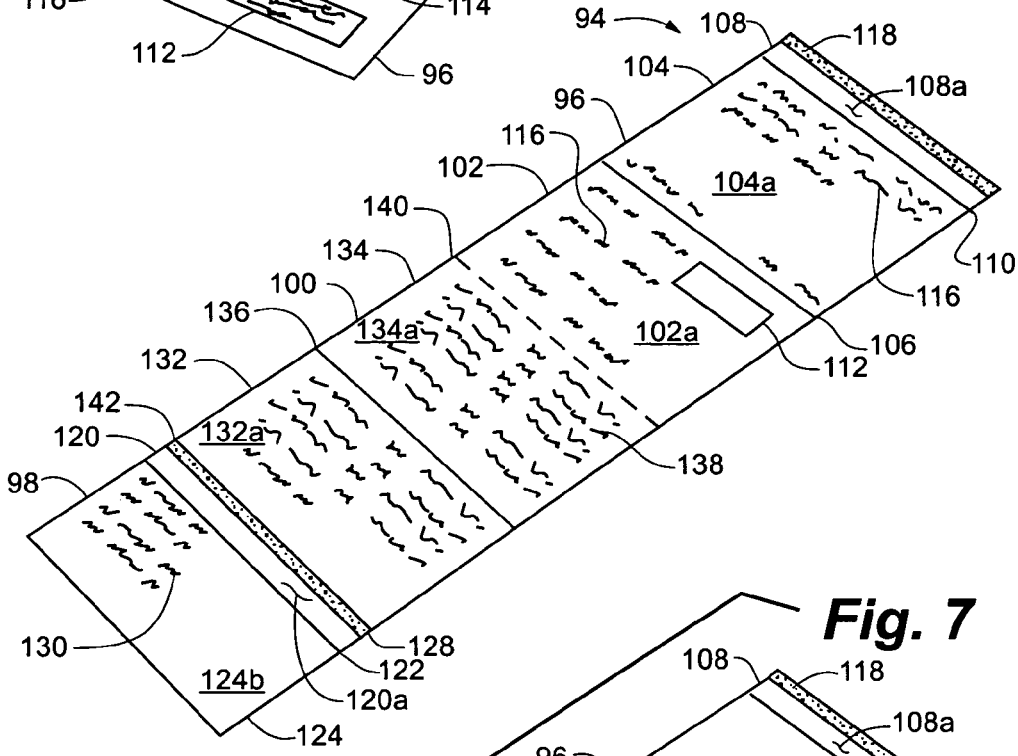
FIG. 6 illustrates a perspective view of the assembly of FIG. 5 in an opened and unfolded condition.
Figure 7:
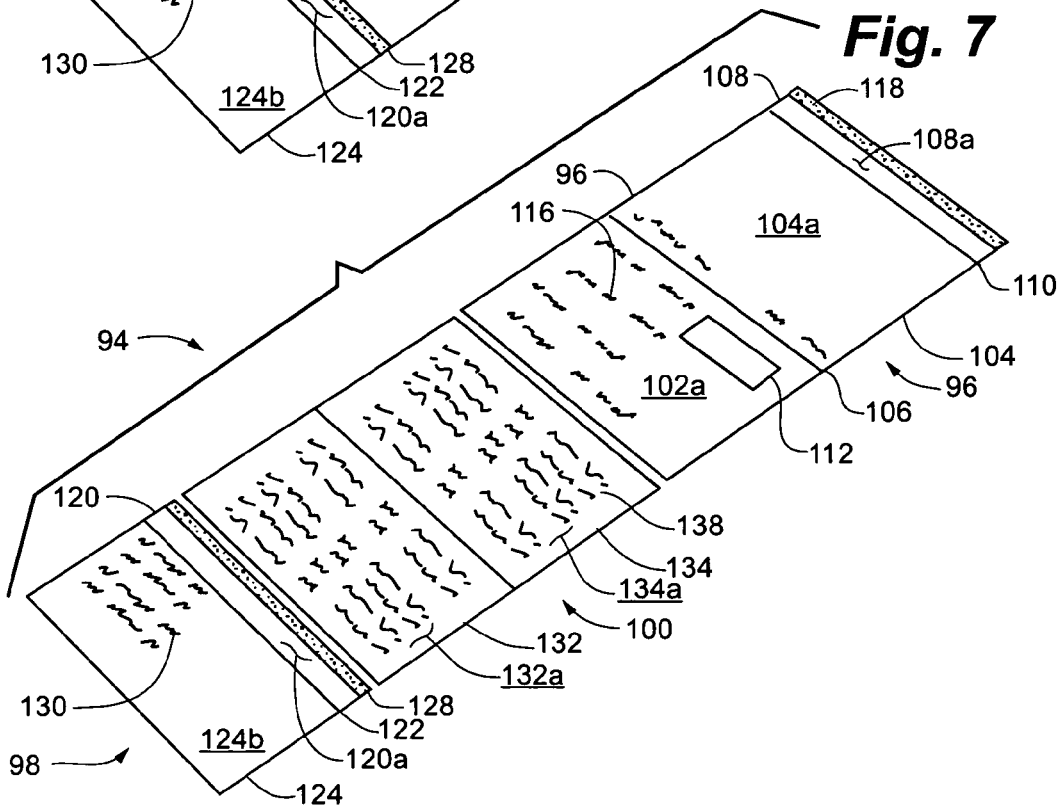
FIG. 7 illustrates a perspective view of the assembly of FIG. 6 in which the outer envelope, insert and inner envelope are detached from each other.

Outer envelope 12, inner envelope 14 and insert 28 of sealed assembly 10 may be attached to each other or loose and held in place by frictional engagement. In addition, inner envelope 14 and insert 28 may be assembled in assembly 10 in many different manners. In a first embodiment, outer envelope 12, inner envelope 14 and insert 28 are not attached, as illustrated in FIG. 4. Inner envelope 14 is nested within insert 28, and specifically, fold 68 of inner envelope 14 is nested within fold 78 of insert 28. Insert 28 is nested within outer envelope 12, and specifically, fold 78 of insert 28 is nested within fold 38 of outer envelope 12. In this embodiment, optional glue dots 90 and 92 may be added to further ensure the sealing of outer envelope 12 and assembly 10 as a whole. In one preferred embodiment, glue dots 90 and 92 are spots or beads of pressure-sensitive adhesive.

In the first embodiment, interior surface 34*a* of front panel 34 of outer envelope 12 is adjacent to exterior surface 76*b* of panel 76 of insert 28. Glue dot 90 may be added between interior surface 34*a* and exterior surface 76*b*. Interior surface 76*a* of panel 76 is adjacent to both exterior surface 16*b* of flap 16 and exterior surface 64*b* of rear panel 64 of inner envelope 14. Glue dot 92 may be added between interior surface 76*a* and exterior surface 64*b*. Interior surface 64*a* of rear panel 64 is adjacent to interior surface 62*a* of front panel 62. Exterior surface 62*b* of front panel 62 of inner envelope 14 is adjacent to interior surface 74*a* of panel 74 of insert 28. Exterior surface 74*b* of panel 74 is adjacent to interior surface 36*a* of rear panel 36 of outer envelope 12.

A second embodiment of assembly 94 is illustrated in FIGS. 5–8 in which outer envelope 96, inner envelope 98 and insert 100 are attached to each other. Outer envelope 96 includes a front panel 102 and a rear panel 104, formed by fold 106, and a flap 108, formed by fold 110. Front panel 102, rear panel 104 and flap 108 include interior surfaces, 102*a*, 104*a* and 108*a*, respectively, and exterior surfaces 102*b*, 104*b* and 108*b*, respectively. Outer envelope 96 may further include a die cut window 112 for a mailing address 114 and indicia 116 on exterior surface 102*b* of front panel 102 and interior surfaces 102*a* of front panel 102 and 104*a* of rear panel 104. Outer envelope 96 further includes adhesive material 118 on interior surface 108*a* of flap 108. Inner envelope 98 includes a flap 120 formed by fold 122, a front panel 124 and a rear panel 126. Flap 120, front panel 124 and rear panel 126 include interior surfaces 120*a*, 124*a* and 126*a*, respectively, and exterior surfaces 120*b*, 124*b* and 126*b*, respectively. Inner envelope 98 further includes adhesive material 128 on interior surface 120*a* of flap 120. Inner envelope 98 may include indicia 130 on exterior surface 124*b* of front panel 124. Insert 100 includes two panels, first panel 132 and second panel 134, formed by fold 136. Panels 132 and 134 both include interior surfaces 132*a* and 134*a*, respectively, and exterior surfaces 132*b* and 134*b*, respectively. Indicia 138 may be included on interior 132*a* and 134*a* and exterior 132*b* and 134*b* surfaces of panels 132 and 134.

Figure 8:
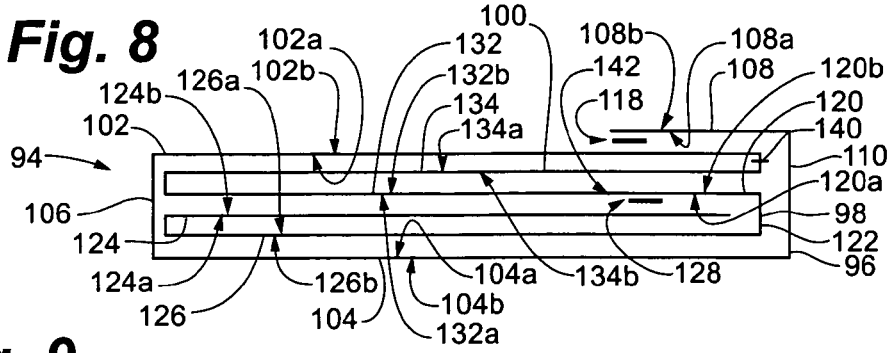
FIG. 8 illustrates a schematic, transverse sectional view of the assembly of FIG. 5.

Outer envelope 96 is attached to insert 100 along a longitudinal line of weakening 140 that connects front panel 102 of outer envelope 96 to panel 134 of insert 100. Insert 100 is attached to inner envelope 98 along a longitudinal line of weakening 142 that connects panel 132 of insert 100 to flap 120 of inner envelope 98. In sealed assembly 94, insert 100 and inner envelope 98 are nested within outer envelope 96, as illustrated in FIG. 8. Interior surface 102*a* of front panel 102 of outer envelope 96 is adjacent to interior surface 134*a* of panel 134 of insert 100. Exterior surface 134*b* is adjacent to exterior surface 132*b* of panel 132 of insert 100 and exterior surface 120*b* of flap 120 of inner envelope 98. Interior surface 132*a* of panel 132 of insert 100 is adjacent to exterior surface 124*b* of front panel 124 of inner envelope 98. Interior surface 120*a* of flap 120 is also adjacent to exterior surface 124*b* of front panel 124. Interior surface 124*a* is adjacent to interior surface 126*a* of rear panel 126 of inner envelope 98. Exterior surface 126*b* is adjacent to interior surface 104*a* of rear panel 104 of outer envelope 96.

Figure 9:
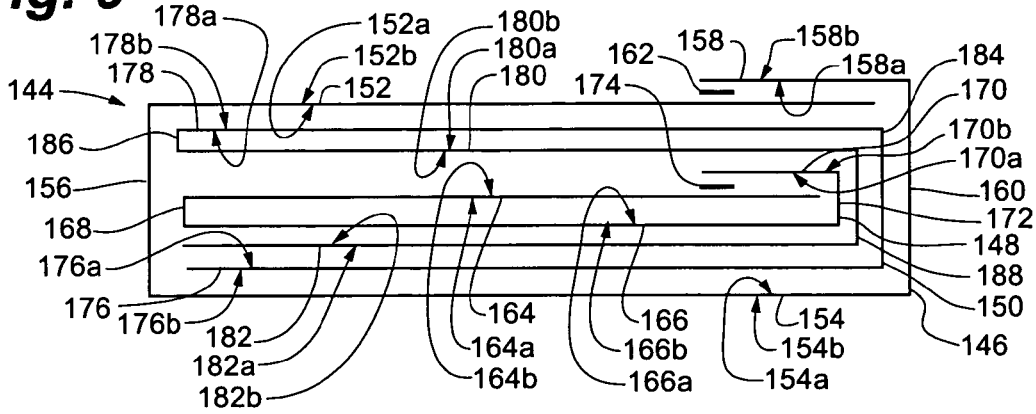
FIG. 9 illustrates a schematic, transverse sectional view of an alternate embodiment of a mailing envelope assembly in accordance with the present invention.

A third embodiment of assembly 144 is illustrated in FIG. 9 in which outer envelope 146, inner envelope 148 and insert 150 are not attached to each other and are instead held in place by frictional engagement. Outer envelope 146 includes a front panel 152 and a rear panel 154, both formed by fold 156, and a flap 158, formed by fold 160. Front panel 152, rear panel 154 and flap 158 include interior surfaces 152*a*, 154*a* and 158*a*, respectively, and exterior surfaces 152*b*, 154*b* and 158*b*, respectively. Outer envelope 146 further includes adhesive material 162 on interior surface 158*a* of flap 158. Inner envelope 148 includes a front panel 164 and a rear panel 166, formed by fold 168, and a flap 170, formed by fold 172. Front panel 164, rear panel 166 and flap 170 include interior surfaces 164*a*, 166*a* and 170*a*, respectively, and exterior surfaces 164*b*, 166*b* and 170*b*, respectively. Inner envelope 148 further includes adhesive material 174 on interior surface 170*a* of flap 170. Insert 150 includes four panels, first panel 176, second panel 178, third panel 180 and fourth panel 182. Panels 176 and 178 are formed by fold 184, panels 178 and 180 are formed by fold 186 and panels 180 and 182 are formed by fold 188. Panels 176, 178, 180 and 182 include interior surfaces 176*a*, 178*a*, 180*a* and 182*a*, respectively, and exterior surfaces 176*b*, 178*b*, 180*b* and 182*b*, respectively.

In the third embodiment, inner envelope 148 is nested inside insert 150, specifically, fold 172 of inner envelope 148 is within fold 188 of insert 150 and fold 188 of insert 150 is within fold 184 of insert 150. Insert 150 is nested inside outer envelope 146, and specifically, fold 184 of insert 150 is within fold 160 of outer envelope 146. Adhesive material 162 is adhered to exterior surface 152*b* of front panel 152 of outer envelope 146. Interior surface 152*a* of front panel 152 is adjacent to exterior surface 178*b* of second panel 178 of insert 150. Interior surface 178*a* is adjacent to interior surface 180*a* of third panel 180. Exterior surface 180*b* is adjacent to both exterior surface 164*b* of front panel 164 and exterior surface 170*b* of flap 170 of inner envelope 148. Interior surface 170*a* of flap 170 is adjacent to exterior portion 164*b* of front panel 164. Interior portion 164*a* is adjacent to interior portion 166*a* of rear panel 166 of inner envelope 148. Exterior surface 166*b* is adjacent to exterior surface 182*b* of fourth panel 182 of insert 148. Interior surface 182*a* is adjacent to interior surface 176*a* of first panel 176. Exterior surface 176*b* is adjacent to interior surface 154*a* of rear panel 154 of outer envelope 146.

Figure 10:
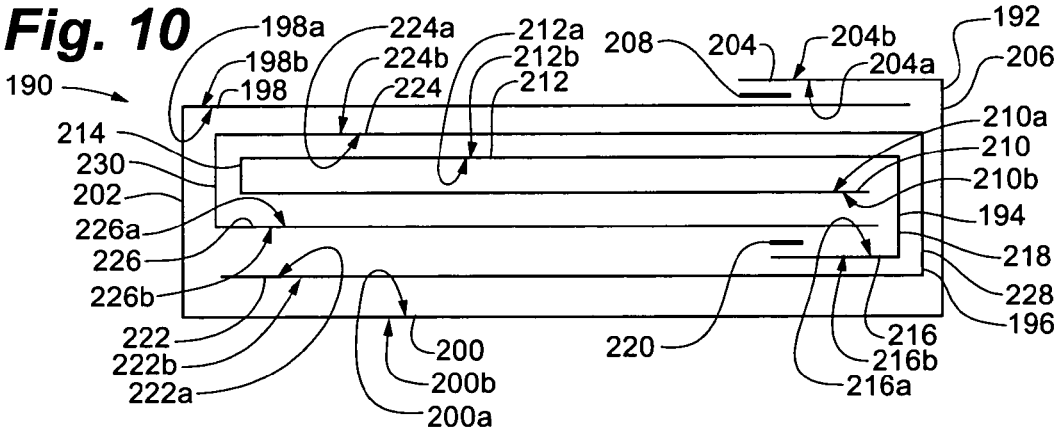
FIG. 10 illustrates a schematic, transverse sectional view of an alternate embodiment of a mailing envelope assembly in accordance with the present invention.

A fourth embodiment of assembly 190 is illustrated in FIG. 10 in which outer envelope 192, inner envelope 194 and insert 196 are not attached to each other and are instead held in place by frictional engagement. Outer envelope 192 includes a front panel 198 and a rear panel 200, both formed by fold 202, and a flap 204 formed by fold 206. Front panel 198, rear panel 200 and flap 204 include interior surfaces 198*a*, 200*a* and 204*a*, respectively, and exterior surfaces 198*b*, 200*b* and 204*b*, respectively. Outer envelope 192 further includes adhesive material 208 on interior surface 204*a* of flap 204. Inner envelope 194 includes a front panel 210 and a rear panel 212, formed by fold 214, and a flap 216, formed by fold 218. Front panel 210, rear panel 212 and flap 216 include interior surfaces 210*a*, 212*a* and 216*a*, respectively, and exterior surfaces 210*b*, 212*b* and 216*b*, respectively. Inner envelope 194 further includes adhesive material 220 on interior surface 216*a* of flap 216. Insert 196 includes three panels, first panel 222, second panel 224 and third panel 226. Panels 222 and 224 are formed by fold 228 and panels 224 and 226 are formed by fold 230. Panels 222, 224 and 226 include interior surfaces 222*a*, 224*a* and 226*a*, respectively, and exterior surfaces 222*b*, 224*b* and 226*b*, respectively.

In the fourth embodiment, inner envelope 194 is nested inside insert 196, and specifically, fold 218 of inner envelope 194 is within fold 228 of insert 196 and fold 214 of inner envelope 194 is within fold 230 of insert 196, as illustrated in FIG. 10. Fold 228 of insert 196 is within fold 206 of outer envelope 192 and fold 230 of insert 196 is within fold 202 of outer envelope 192. Adhesive material 208 is adhered to exterior surface 198*b* of front panel 198 of outer envelope 192. Interior surface 198*a* of front panel 198 of outer envelope 192 is adjacent to exterior surface 224*b* of second panel 224 of insert 196. Interior surface 224*a* of second panel 224 is adjacent to exterior surface 212*b* of rear panel 212 of inner envelope 194. Interior surface 212*a* of rear panel 212 is adjacent to interior surface 210*a* of front panel 210. Exterior surface 210*b* is adjacent to interior surface 226*a* of third panel 226 of insert 196. Exterior surface 226*b* of third panel 226 is adjacent to interior surface 216*a* of flap 216 and interior surface 222*a* of first panel 222. Exterior surface 216*b* of flap 216 is adjacent to interior surface 222*a* of first panel 222. Exterior surface 222*b* of first panel 222 is adjacent to interior surface 200*a* of rear panel 200 of outer envelope 192.

Figure 11:
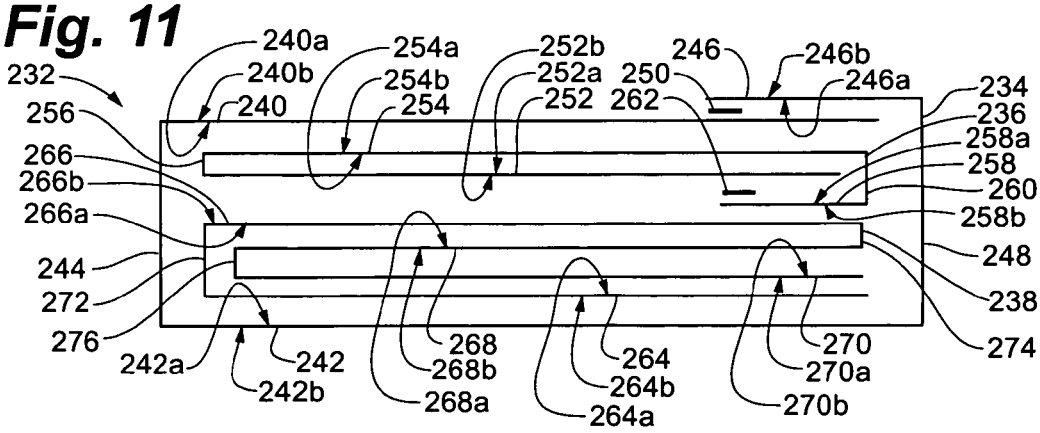
FIG. 11 illustrates a schematic, transverse sectional view of an alternate embodiment of a mailing envelope assembly in accordance with the present invention.

A fifth embodiment of assembly 232 is illustrated in FIG. 11 in which outer envelope 234, inner envelope 236 and insert 238 are not attached to each other and are instead held in place by frictional engagement. Outer envelope 234 includes a front panel 240 and a rear panel 242, formed by fold 244, and a flap 246, formed by fold 248. Front panel 240, rear panel 242 and flap 246 include interior surfaces 240*a*, 242*a* and 246*a*, respectively, and exterior surfaces 240*b*, 242*b* and 246*b*, respectively. Outer envelope 234 further includes adhesive material 250 on interior surface 246*a* of flap 246. Inner envelope 236 includes a front panel 252 and a rear panel 254, formed by fold 256, and a flap 258, formed by fold 260. Front panel 252, rear panel 254 and flap 258 include interior surfaces 252*a*, 254*a* and 258*a*, respectively, and exterior surfaces 252*b*, 254*b* and 258*b*, respectively. Inner envelope 236 further includes adhesive material 262 on interior surface 258*a* of flap 258. Insert 238 includes four panels, first panel 264, second panel 266, third panel 268 and fourth panel 270. Panels 264 and 266 are formed by fold 272, panels 266 and 268 are formed by fold 274 and panels 268 and 270 are formed by fold 276. Panels 264, 266, 268 and 270 include interior surfaces, 264*a*, 266*a*, 268*a* and 270*a*, respectively, and exterior surfaces 264*b*, 266*b*, 268*b* and 270*b*, respectively.

In the fifth embodiment, inner envelope 236 lies on top of insert 238, and both are inside outer envelope 234, within folds 244 and 248 of outer envelope 234, as illustrated in FIG. 11. Adhesive material 250 of flap 246 is adhered to and interior surface 246*a* of flap 246 is adjacent to exterior surface 240*b* of front panel 240 of outer envelope 234. Interior surface 240*a* is adjacent to exterior surface 254*b* of rear panel 254 of inner envelope 236. Interior surface 254*a* is adjacent to interior surface 252*a* of front panel 252 of inner envelope 236. Exterior surface 252*b* is adjacent to both interior surface 258*a* of flap 258 and exterior surface 266*b* of second panel 266. Exterior surface 258*b* of flap 258 of inner envelope 236 is also adjacent to exterior surface 266*b* of second panel 266 of insert 238. Interior surface 266*a* of second panel 266 is adjacent to interior surface 268*a* of third panel 268. Exterior surface 268*b* is adjacent to exterior surface 270*b* of fourth panel 270. Interior surface 270*a* is adjacent to interior surface 264*a* of first panel 264. Exterior surface 264*b* is adjacent to interior surface 242*a* of rear panel 242 of outer envelope 234. Fold 276 is within fold 272 and therefore panels 268 and 270 are within panels 264 and 266.

Figure 12:
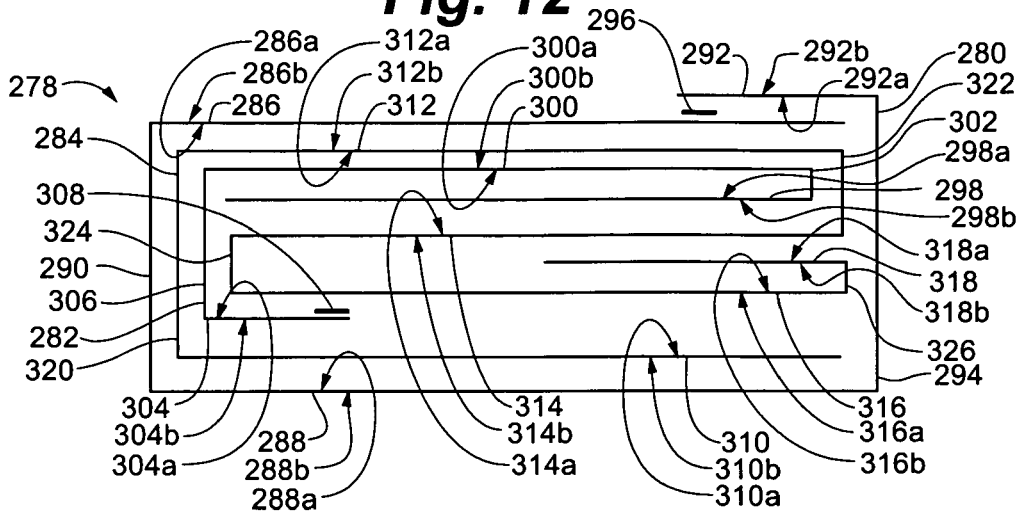
FIG. 12 illustrates a schematic, transverse sectional view of an alternate embodiment of a mailing envelope assembly in accordance with the present invention.

A sixth embodiment of assembly 278 is illustrated in FIG. 12 in which outer envelope 280, inner envelope 282 and insert 284 are not attached to each other and are instead held in place by frictional engagement. Outer envelope 280 includes a front panel 286 and a rear panel 288, formed by fold 290, and a flap 292, formed by fold 294. Front panel 286, rear panel 288 and flap 292 include interior surfaces 286*a*, 288*a* and 292*a*, respectively, and exterior surfaces 286*b*, 288*b* and 292*b*, respectively. Outer envelope 280 further includes adhesive material 296 on interior surface 292*a* of flap 292. Inner envelope 282 includes a front panel 298 and a rear panel 300, formed by fold 302, and a flap 304, formed by fold 306. Front panel 298, rear panel 300 and flap 304 include interior surfaces 298*a*, 300*a* and 304*a*, respectively, and exterior surfaces 298*b*, 300*b* and 304*b*, respectively. Inner envelope 282 further includes adhesive material 308 on interior surface 304*a* of flap 304. Insert 284 includes five panels, first panel 310, second panel 312, third panel 314, fourth panel 316 and fifth panel 318. Panels 310 and 312 are formed by fold 320, panels 312 and 314 are formed by fold 322, panels 314 and 316 are formed by fold 324 and panels 316 and 318 are formed by fold 326. Panels 310, 312, 314, 316 and 318 include interior surfaces 310*a*, 312*a*, 314*a*, 316*a* and 318*a*, respectively, and exterior surfaces 310*b*, 312*b*, 314*b*, 316*b* and 318*b*, respectively.

In the sixth embodiment, inner envelope 282 is partly nested within insert 284, and more specifically, fold 302 of inner envelope 282 is within fold 322 of insert 284 and fold 306 of inner envelope 282 is within fold 320 of insert 284, as illustrated in FIG. 12. Adhesive material 296 is adhered to and interior surface 292*a* of flap 292 is adjacent to exterior surface 286*b* of front panel 286 of outer envelope 280. Interior surface 286*a* of front panel 286 is adjacent to exterior surface 312*b* of second panel 312 of insert 284. Interior surface 312*a* is adjacent to exterior surface 300*b* of rear panel 300 of inner envelope 282. Interior surface 300*a* of rear panel 300 is adjacent to interior surface 298*a* of front panel 298 of inner envelope 282. Exterior surface 298*b* of front panel 298 of inner envelope 282 is adjacent to interior surface 314*a* of third panel 314 of insert 284. Exterior surface 314*b* of third panel 314 is adjacent to interior surface 318*a* of fifth panel 318 and also to exterior surface 316*b* of fourth panel 316. Exterior surface 318*b* of fifth panel 318 is also adjacent to exterior surface 316*b* of fourth panel 316. Interior surface 316*a* of fourth panel 316 is adjacent to interior surface 304*a* of flap 304 of inner envelope 282 and also to interior surface 310*a* of first panel 310 of insert 284. Exterior surface 304*b* of flap 304 is also adjacent to interior surface 310*a* of first panel 310. Exterior surface 310*b* of first panel 310 is adjacent to interior surface 288*a* of rear panel 288 of outer envelope 280.

Figure 13:
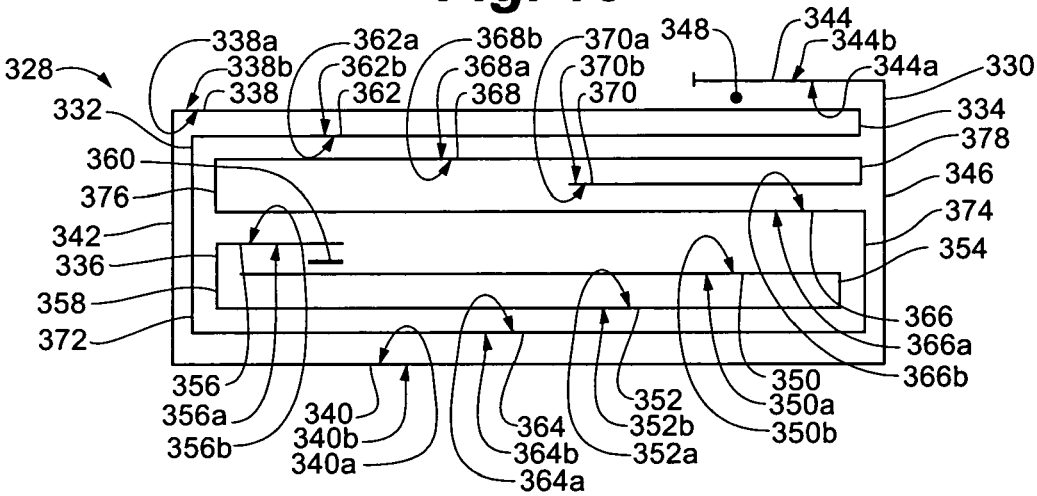
FIG. 13 illustrates a schematic, transverse sectional view of an alternate embodiment of a mailing envelope assembly in accordance with the present invention.

A seventh embodiment of assembly 328 is illustrated in FIG. 13 in which outer envelope 330 is attached to insert 332 along a longitudinal line of weakening 334 and inner envelope 336 is not attached to either outer envelope 330 or insert 332 and is held in place inside insert 332 by frictional engagement. Outer envelope 330 includes a front panel 338 and a rear panel 340, formed by fold 342, and a flap 344, formed by fold 346. Front panel 338, rear panel 340 and flap 344 include interior surfaces 338*a*, 340*a* and 344*a*, respectively, and exterior surfaces 338*b*, 340*b* and 344*b*, respectively. Outer envelope 330 further includes adhesive material 348 on interior surface 344*a* of flap 344. Inner envelope 336 includes a front panel 350 and a rear panel 352, formed by fold 354, and a flap 356, formed by fold 358. Front panel 350, rear panel 352 and flap 356 include interior surfaces 350*a*, 352*a* and 356*a*, respectively, and exterior surfaces 350*b*, 352*b* and 356*b*, respectively. Inner envelope 336 further includes adhesive material 360 on interior surface 356*a* of flap 356. Insert 332 includes five panels, first panel 362, second panel 364, third panel 366, fourth panel 368 and fifth panel 370. Panels 362, 364, 366, 368 and 370 include interior surfaces 362*a*, 364*a*, 366*a*, 368*a* and 370*a*, respectively, and exterior surfaces 362*b*, 364*b*, 366*b*, 368*b* and 370*b*, respectively. Panels 362 and 364 are formed by fold 372, panels 364 and 366 are formed by fold 374, panels 366 and 368 are formed by fold 376 and panels 368 and 370 and are formed by fold 378.

In the seventh embodiment, inner envelope 336 is nested within insert 332, specifically fold 354 of inner envelope 336 is within fold 374 of insert 332 and fold 358 of inner envelope 336 is within fold 372 of insert 332, as illustrated in FIG. 13. Adhesive material 348 is adhered to and interior surface 344*a* is adjacent to exterior surface 338*b* of front panel 338 of outer envelope 330. First panel 362 of insert 332 is attached to front panel 338 of outer envelope 330 by longitudinal line of weakening 334. Interior surface 338*a* of front panel 338 of outer envelope 330 is adjacent to exterior surface 362*b* of first panel 362. Interior surface 362*a* is adjacent to interior surface 368*a* of fourth panel 368. Exterior surface 368*b* is adjacent to both exterior surface 370*b* of fifth panel 370 and exterior surface 366*b* of third panel 366. Interior surface 370*a* of fifth panel 370 is also adjacent to exterior surface 366*b* of third panel 366. Interior surface 366*a* is adjacent to exterior surfaces 356*b* and 350*b* of flap 356 and front panel 350, respectively, of inner envelope 336. Interior surface 356*a* of flap 356 is also adjacent to exterior surface 350*b* of front panel 350. Interior surface 350*a* of front panel 350 is adjacent to interior portion 352*a* of rear panel 352 of inner envelope 336. Exterior surface 352*b* is adjacent to interior surface 364*a* of second panel 364 of insert 332. Exterior surface 364*b* is adjacent to interior surface 340*a* of rear panel 340 of outer envelope 330.

Figure 14:
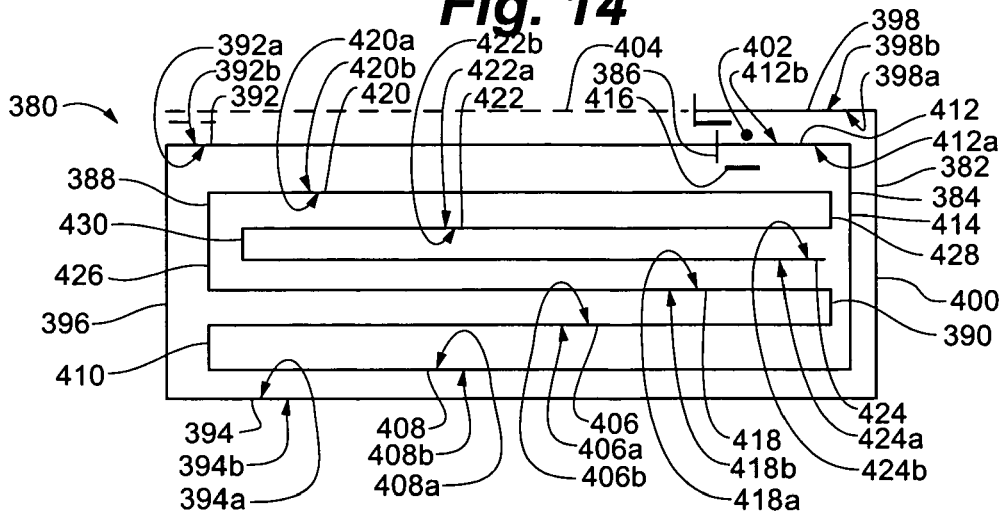
FIG. 14 illustrates a schematic, transverse sectional view of an alternate embodiment of a mailing envelope assembly in accordance with the present invention.

An eighth embodiment of assembly 380 is illustrated in FIG. 14 in which outer envelope 382 is attached to inner envelope 384 along a longitudinal line of weakening 386 and inner envelope 384 is attached to insert 388 along a longitudinal line of weakening 390. Outer envelope 382 includes a front panel 392 and a rear panel 394, formed by fold 396, and a flap 398, formed by fold 400. Front panel 392, rear panel 394 and flap 398 include interior surfaces 392*a*, 394*a* and 398*a*, respectively, and exterior surfaces 392*b*, 394*b* and 398*b*, respectively. Outer envelope 382 further includes adhesive material 402 on interior surface 398*a* of flap 398. Outer envelope 382 further includes an alternate flap extension 404. Inner envelope 384 includes a front panel 406 and a rear panel 408, formed by fold 410, and a flap 412, formed by fold 414. Front panel 406, rear panel 408 and flap 412 include interior surfaces 406*a*, 408*a* and 412*a*, respectively, and exterior surfaces 406*b*, 408*b* and 412*b*, respectively. Inner envelope 384 further includes adhesive material 416 on interior surface 412*a* of flap 412. Insert 388 includes four panels, first panel 418, second panel 420, third panel 422 and fourth panel 424. Panels 418, 420, 422 and 424 include interior surfaces 418*a*, 420*a*, 422*a* and 424*a*, respectively, and exterior surfaces 418*b*, 420*b*, 422*b* and 424*b*, respectively. Panels 418 and 420 are formed by fold 426, panels 420 and 422 are formed by fold 428, and panels 422 and 424 are formed by fold 430.

In the eighth embodiment, insert 388 is nested within inner envelope 384, specifically within fold 414, and inner envelope 384 is nested within outer envelope 382, specifically fold 414 is within fold 400 of outer envelope 382. Flap 412 of inner envelope 384 is attached to front panel 392 of outer envelope 382 and front panel 406 of inner envelope 384 is attached to first panel 418 of insert 388. Alternate flap extension 404 is contiguous with flap 398 of outer envelope 382. Interior surface 398*a* of flap 398 of outer envelope 382 is adjacent to exterior surface 412*b* of flap 412 of inner envelope 384 and adhesive material 402 is adhered to exterior surface 392*b* of front panel 392 of outer envelope 382. Front panel 392 of outer envelope 382 is contiguous with flap 412 of inner envelope 384. Interior surfaces 392*a* and 412*a* of front panel 392 of outer envelope 382 and flap 412 of inner envelope 384, respectively, are both adjacent to exterior surface 420*b* of second panel 420 of insert 388. Interior surface 420*a* of second panel 420 is adjacent to interior surface 422*a* of third panel 422. Exterior surface 422*b* of third panel 422 is adjacent to exterior surface 424*b* of fourth panel 424. Interior surface 424*a* is adjacent to interior surface 418*a* of first panel 418. Fold 430 of insert 388 is nested within fold 426 of insert 388. First panel 418 is attached to and contiguous with front panel 406 of inner envelope 384. Exterior surface 418*b* is adjacent to exterior surface 406*b* of front panel 406 of inner envelope 384. Interior surface 406*a* of front panel 406 is adjacent to interior surface 408*a* of rear panel 408. Exterior surface 408*b* of rear panel 408 is adjacent to interior surface 394*a* of rear panel 394 of outer envelope 382.

Figure 15:
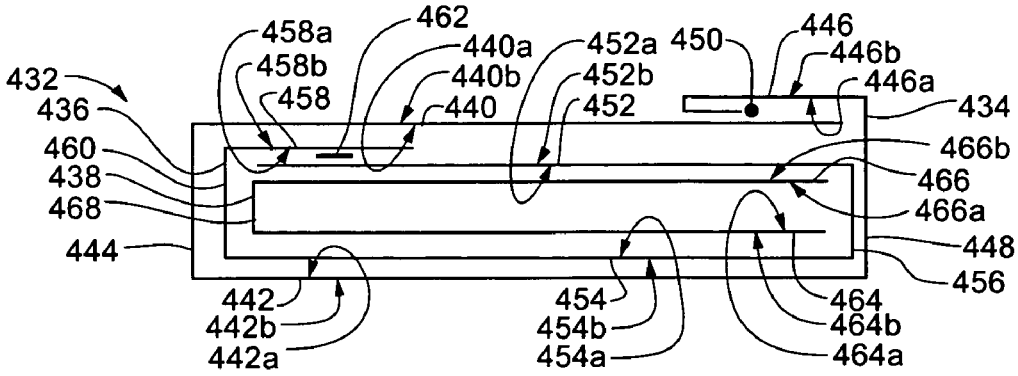
FIG. 15 illustrates a schematic, transverse sectional view of an alternate embodiment of a mailing envelope assembly in accordance with the present invention.

A ninth embodiment of assembly 432 is illustrated in FIG. 15 in which outer envelope 434, inner envelope 436 and insert 438 are not attached and are retained inside outer envelope 434 by frictional engagement. Outer envelope 434 includes a front panel 440 and a rear panel 442, formed by fold 444, and a flap 446, formed by fold 448. Front panel 440, rear panel 442 and flap 446 include interior surfaces 440*a*, 442*a* and 446*a*, respectively, and exterior surfaces 440*b*, 442*b* and 446*b*, respectively. Outer envelope 434 further includes adhesive material 450 on interior surface 446*a* of flap 446. Inner envelope 436 includes a front panel 452 and a rear panel 454, both formed by fold 456, and a flap 458, formed by fold 460. Front panel 452, rear panel 454 and flap 458 include interior surfaces 452*a*, 454*a* and 458*a*, respectively, and exterior surfaces 452*b*, 454*b* and 458*b*, respectively. Inner envelope 436 further includes adhesive material 462 on interior surface 458*a* of flap 458. Insert 438 includes two panels; first panel 464 and second panel 466. Panels 464 and 466 are formed by fold 468. Panels 464 and 466 include interior surfaces 464*a* and 466*a*, respectively, and exterior surfaces 464*b* and 466*b*, respectively.

In the ninth embodiment, insert 438 is nested within inner envelope 436, specifically fold 468 of insert 438 is within fold 460 of inner envelope 436. Inner envelope 436 is nested within outer envelope 434, specifically fold 460 is within fold 444 of outer envelope 434 and fold 456 of inner envelope 436 is within fold 448 of outer envelope 434. Adhesive material 450 is adhered to and interior surface 446*a* of front panel 446 is adjacent to exterior surface 440*b* of front panel 440 of outer envelope 434. Interior surface 440*a* of front panel 440 of outer envelope 434 is adjacent to exterior surfaces 458*b* and 452*b* of flap 458 and front panel 452, respectively, of inner envelope 436. Interior surface 458*a* of flap 458 is adjacent to exterior surface 452*b* of front panel 452. Interior surface 452*a* is adjacent to exterior surface 466*b* of second panel 466. Interior surface 466*a* of second panel 466 is adjacent to interior surface 464*a* of first panel 464. Exterior surface 464*b* of first panel 464 is adjacent to interior surface 454*a* of rear panel 454 of inner envelope 436. Exterior surface 454*b* is adjacent to interior surface 442*a* of rear panel 442 of outer envelope 434.

Figure 16:
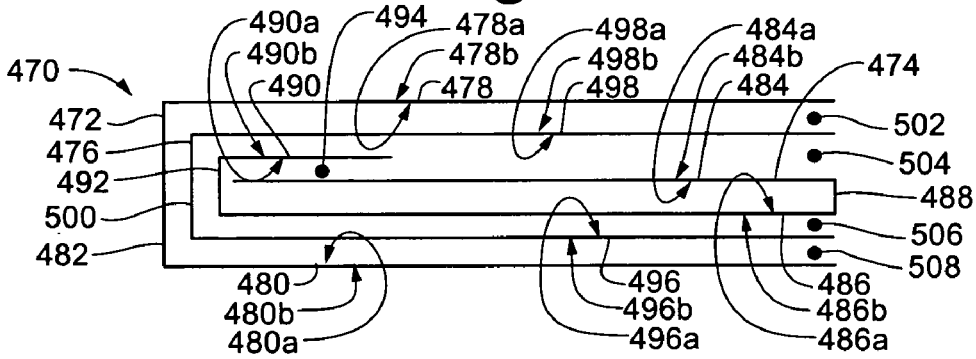
FIG. 16 illustrates a schematic, transverse sectional view of an alternate embodiment of a mailing envelope assembly in accordance with the present invention.

A tenth embodiment of assembly 470 is illustrated in FIG. 16 in which the outer envelope 472, inner envelope 474 and insert 476 are not attached to each other and are retained inside outer envelope 472 by frictional engagement. Outer envelope 472 includes a front panel 478 and a rear panel 480, formed by fold 482. Front panel 478 and rear panel 480 have interior surfaces 478*a* and 480*a*, respectively, and exterior surfaces 478*b* and 480*b*, respectively. Inner envelope 474 includes a front panel 484 and a rear panel 486, formed by fold 488 and a flap 490, formed by fold 492. Front panel 484, rear panel 486 and flap 490 include interior surfaces 484*a*, 486*a* and 490*a*, respectively, and exterior surfaces 484*b*, 486*b* and 490*b*, respectively. Inner envelope 474 further includes adhesive material 494 on interior portion 490*a* of flap 490. Insert 476 includes two panels, first panel 496 and second panel 498, formed by fold 500. Panels 496 and 498 include interior surfaces 496*a* and 498*a*, respectively, and exterior surfaces 496*b* and 498*b*, respectively. Spots of adhesive 502, 504, 506 and 508 assist in sealing assembly 470.

In the tenth embodiment, inner envelope 474 is nested within insert 476, specifically fold 492 of inner envelope 474 is within fold 500 of insert 476 and insert 476 is nested within outer envelope 472, specifically fold 500 is within fold 482 of outer envelope 472, as illustrated in FIG. 16. Interior surface 478*a* of front panel 478 of outer envelope 472 is adjacent to exterior surface 498*b* of second panel 498 of insert 476. Adhesive spot 502 is between interior surface 478*a* and exterior surface 498*b*. Interior surface 498*a* is adjacent to both exterior surface 490*b* of flap 490 and exterior surface 484*b* of front panel 484 of inner envelope 474. Adhesive spot 504 is between interior surface 498*a* and exterior surface 484*b*. Interior surface 484*a* of front panel 484 is adjacent to interior surface 486*a* of rear panel 486 of inner envelope 474. Exterior surface 486*b* of rear panel 486 of inner envelope 474 is adjacent to interior surface 496*a* of first panel 496 of insert 476. Adhesive spot 506 is between exterior surface 486*b* and interior surface 496*a*. Exterior surface 496*b* of first panel 496 of insert 476 is adjacent to interior surface 480*a* of rear panel 480 of outer envelope 472. Adhesive spot 508 is between exterior surface 496*b* and interior surface 480*a*.

Figure 17:
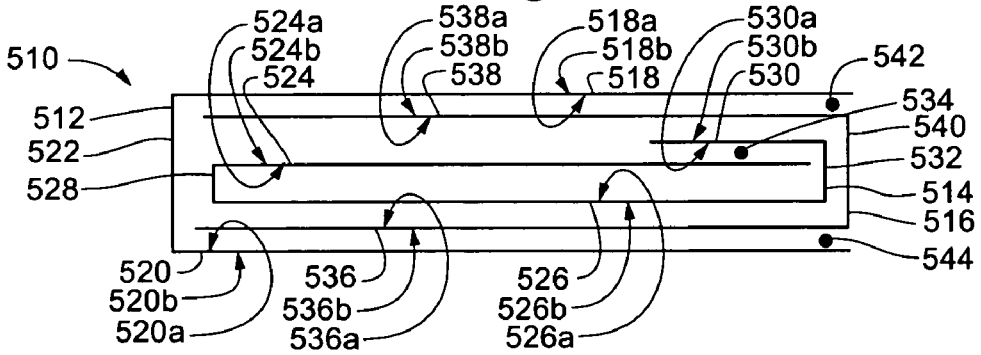
FIG. 17 illustrates a schematic, transverse sectional view of an alternate embodiment of a mailing envelope assembly in accordance with the present invention.

An eleventh embodiment of assembly 510 is illustrated in FIG. 17 in which the outer envelope 512, inner envelope 514 and insert 516 are not attached to each other and are retained inside outer envelope 512 by frictional engagement. Outer envelope 512 includes a front panel 518 and a rear panel 520, formed by fold 522. Front panel 518 and rear panel 520 include interior surfaces, 518*a* and 520*a*, respectively, and exterior surfaces 518*b* and 520*b*, respectively. Inner envelope 514 includes a front panel 524 and a rear panel 526, formed by fold 528 and a flap 530, formed by fold 532. Front panel 524, rear panel 526 and flap 530 include interior surfaces 524*a*, 526*a* and 530*a*, respectively, and exterior surfaces 524*b*, 526*b* and 530*b*, respectively. Inner envelope 514 further includes adhesive material 534 on interior portion 530*a* of flap 530. Insert 516 includes two panels, first panel 536 and second panel 538, formed by fold 540. Panels 536 and 538 include interior surfaces 536*a* and 538*a*, respectively, and exterior surfaces 536*b* and 538*b*, respectively. Spots of adhesive 542 and 544 assist in sealing assembly 510.

In the eleventh embodiment, inner envelope 514 is nested within insert 516, specifically fold 532 of inner envelope 514 is within fold 540 of insert 516, as illustrated in FIG. 17. Interior surface 518*a* of front panel 518 of outer envelope 512 is adjacent to exterior surface 538*b* of second panel 538 of insert 516. Adhesive spot 542 is between interior surface 518*a* and exterior surface 538*b*. Interior surface 538*a* of second panel 538 of insert 516 is adjacent to both exterior surface 530*b* of flap 530 and exterior surface 524*b* of front panel 524 of inner envelope 514. Interior surface 524*a* of front panel 524 is adjacent to interior surface 526*a* of rear panel 526. Exterior surface 526*b* of rear panel 526 of inner envelope 514 is adjacent to interior surface 536*a* of first panel 536 of insert 516. Exterior surface 536*b* is adjacent to interior surface 520*a* of rear panel 520 of outer envelope 512. Adhesive spot 544 is between exterior surface 536*b* and interior surface 520*a*.

A method of conducting a survey in accordance with the invention is also provided. The method includes mailing a mailing envelope assembly 10, 94, 144, 190, 232, 278, 328, 380, 432, 470 or 510 in accordance with the invention to a recipient. The insert 28, 100, 150, 196, 238, 284, 332, 388, 438, 476 or 516 comprises a survey form that includes instructions for a recipient to complete. The method further includes receiving the completed survey form from the recipient contained in the inner envelope 14, 98, 148, 194, 236, 282, 336, 384, 436, 474 or 514.

A method of making assemblies 10, 94, 144, 190, 232, 278, 328, 380, 432, 470 and 510 in accordance with the invention is also provided. Equipment for practicing the method is well known in the art. The method includes conveying a web of material. A web is an elongated strip of flexible material and may be obtained from a large roll of paper or other material.

The method further includes folding the web to define a longitudinal web region from which the inner envelope 14, 98, 148, 194, 236, 282, 336, 384, 436, 474 or 514 is formed. The method still further includes applying adhesive material 72 transversely to a surface of the web at spaced transverse intervals in a location for the inner envelope 14 portion. In one embodiment, adhesive material is envelope spine glue.

The method yet further includes longitudinally folding the web so that the adhesive material 72 attaches the web at the spaced intervals to form the inner envelope portion 14. The longitudinal fold will be at approximately the center of the transversely applied adhesive material, at fold 66.

The method further includes applying adhesive material 70, 118, 174, 220, 262, 308, 360, 416, 462, 494 or 534 longitudinally on the surface of the web for an inner envelope flap adhesion. In one embodiment, adhesive material 70, 118, 174, 220, 262, 308, 360, 416, 462, 494 or 534 is remoistenable adhesive. The method further includes longitudinally folding the web to form the inner envelope flap 16, 120, 170, 216, 258, 304, 356, 412, 458, 490 or 530 along fold 68, 122, 172, 218, 260, 306, 358, 414, 460, 492 or 532 adjacent the flap adhesive material 70, 118, 174, 220, 262, 308, 360, 416, 462, 494 or 534.

The method further includes longitudinally folding the web in a web region not occupied by the inner envelope 14, 98, 148, 194, 236, 282, 336, 384, 436, 474 or 514 to form the insert portion 28, 100, 150, 196, 238, 284, 332, 388, 438, 476 or 516. In one embodiment, the web is folded one time, forming an insert 28, 100, 438, 476 or 516 with two panels 74 and 76, 132 and 134, 464 and 466, 496 and 498, or 536 and 538, as illustrated in FIGS. 2, 4, 6, 7, 8, 15, 16 and 17, respectively. In another embodiment, the web is folded two times, forming an insert 196 with three panels 222, 224 and 226, as illustrated in FIG. 10. In another embodiment, the web is folded three times, forming an insert 150, 238 or 388 with four panels, 176, 178, 180 and 182, 264, 266, 268 and 270, or 418, 420, 422 and 424, as illustrated in FIGS. 9, 11 and 14, respectively. In yet another embodiment, the web is folded four times, forming an insert 284 or 332 with five panels 310, 312, 314, 316 and 318, or 362, 364, 366, 368 or 370, as illustrated in FIGS. 12 and 13, respectively.

The method may further include forming a line of weakening 142 or 390 longitudinally on the web adjacent to the transversely applied adhesive material 128 or 416 to allow subsequent separation of the inner envelope 98 or 384 from an insert portion 100 or outer envelope 382 of the assembly 94 or 380, as illustrated in FIGS. 6, 7, 8, and 14. The line of weakening 142 or 390 may be a line of perforations or a score line that weakens the web along the line and can be more easily separated or removed. In one preferred embodiment, the line of weakening 142 or 390 is a line of perforations.

The method further includes longitudinally folding the web to form an outer envelope panel, subsequently forming outer envelope 12, 96, 146, 192, 234, 280, 330, 382, 434, 472 or 512. The method further includes applying adhesive 48, 118, 162, 208, 250, 296, 348, 402 or 450 longitudinally on a region of the web that will form the outer envelope flap 44, 108, 158, 204, 246, 292, 344, 398 or 446.

The method may further include forming a line of weakening 140, 334 or 386 longitudinally on the web adjacent to the panel that will become outer envelope 96, 330 or 382, as illustrated in FIGS. 6, 7, 8, 13 and 14. The line of weakening 140, 334 or 386 may be a line of perforations or a score line that weakens the web along the line and can be more easily separated or removed. In one preferred embodiment, the line of weakening 140, 334 or 386 is a line of perforations.

The lines of perforations or score lines may be applied for easy removal of the inner envelope 98 or 384 and/or the insert 100, 332 or 388. In one embodiment, a scissor image, dotted or similar line is printed on the web to indicate a line where the separation by cutting should take place in the event a line of weakening is not provided. In one embodiment, perforating is done by an arc of a pneumatically operated wheel having a perforation rate of 60–65% and with an incremental spacing of 10 to 12 cuts and ties per linear inch. However, any other perforation method as known in the art may be used to form a desired line of perforations or other line of weakening.

The method further includes longitudinally folding the outer envelope web region to form the outer envelope 12, 96, 146, 192, 234, 280, 330, 382, 434, 472 or 512 and outer envelope flap 44, 108, 158, 204, 246, 292, 344, 398 or 446, in which outer envelope 12, 96, 146, 192, 234, 280, 330, 382, 434, 472 or 512 encloses the inner envelope 14, 98, 148, 194, 236, 282, 336, 384, 436, 474 or 514 and the insert portion 28, 100, 150, 196, 238, 284, 332, 388, 438, 476 or 516. In a preferred embodiment, adhesive material 48, 118, 162, 208, 250, 296, 348, 402 or 450 is applied to the envelope flap 44, 108, 158, 204, 246, 292, 344, 398 or 446, preferably pressure-sensitive adhesive.

The method still further includes transversely cutting the web to form the individual mailing envelope assemblies 10, 94, 144, 190, 232, 278, 328, 380, 432, 470 and 510.

While the invention has been described with respect to certain preferred embodiments, as will be appreciated by those skilled in the art, it is to be understood that the invention is capable of numerous changes, modifications and rearrangements and such changes, modifications and rearrangements are intended to be covered by the following claims.

What is claimed is:

1. A method of making a mailing envelope assembly composed of an inner envelope and an insert portion contained in an outer envelope comprising:

conveying a web of material;

longitudinally folding said web to define a longitudinal web region from which the inner envelope is formed;

applying adhesive material transversely to a surface of said web at spaced transverse intervals in a location for the inner envelope portion;

longitudinally folding said web so that said adhesive material attaches the web at the spaced intervals to form the inner envelope portion;

applying adhesive material longitudinally on the surface of said web for an inner envelope flap adhesion;

longitudinally folding the web to form the inner envelope flap adjacent the flap adhesion;

longitudinally folding the web in a web region not occupied by the inner envelope to form the insert portion;

longitudinally folding said web to form an outer envelope panel;

applying adhesive longitudinally on a region of the web that will form the outer envelope flap;

longitudinally folding said outer envelope web region to form the outer envelope and outer envelope flap in a web region not occupied by the inner envelope and the insert portion, which outer envelope encloses an inner portion and an outer portion of the inner envelope and an inner portion and an outer portion of the insert portion; and periodically transversely cutting the web to form the individual mailing envelope assemblies.

2. The method of claim 1 further comprising, prior to said longitudinally folding the web to form an outer envelope panel, forming a line of weakening longitudinally on said web adjacent said transversely applied adhesive material to allow subsequent separation of said inner envelope from a non-inner envelope portion of the assembly.

3. The method of claim 2 wherein said line of weakening is a line of perforations.

4. The method of claim 1 further comprising, prior to said longitudinally folding the outer envelope region, forming a line of weakening longitudinally on said web adjacent said panel.

5. The method of claim 4 wherein said line of weakening is a line of perforations.

6. The method of claim 1 wherein adhesive material is applied to a surface of the outer envelope flap.

7. The method of claim 6 wherein the adhesive material is pressure-sensitive adhesive.

8. The method of claim 1 wherein the adhesive material applied transversely on the surface of the web at spaced intervals in a location for the inner envelope portion is envelope spine glue.

9. The method of claim 1 wherein the adhesive material applied longitudinally on the surface of the web for the inner envelope flap adhesion is remoistenable adhesive.

10. The method of claim 1 wherein the insert is a survey form that includes instructions for a recipient to complete.

11. A method of conducting a survey comprising:

mailing a mailing envelope assembly comprising a sealed outer envelope, an inner envelope contained within said outer envelope having a flap, closed ends and an interior portion having an inner longitudinal length and an inner transverse width, and a foldable survey form that includes instructions for a recipient to complete contained and oriented within the outer envelope, the form having a longitudinal length as contained in the outer envelope that is greater than the interior longitudinal length of said inner envelope and the longitudinal length of the form as contained in the outer envelope being no greater than twice the interior transverse width of the inner envelope and the form having a transverse width as contained in the outer envelope that is no greater than the longitudinal length of the interior portion of the inner envelope;

folding the completed survey transversely in half;

rotating the completed survey 90° relative to the orientation of the form as received in the sealed outer envelope such that the folded insert portion fits within the interior portion of the inner envelope; and receiving the completed survey form from the recipient contained in the inner envelope.

12. A method of making a mailing envelope assembly composed of an inner envelope and an insert portion contained in an outer envelope comprising:

conveying a web of material;

longitudinally folding said web to define a longitudinal web region from which the inner envelope is formed;

applying adhesive material transversely to a surface of said web at spaced transverse intervals in a location for the inner envelope portion;

longitudinally folding said web so that said adhesive material attaches the web at the spaced intervals to form the inner envelope portion;

applying adhesive material longitudinally on the surface of said web for an inner envelope flap adhesion;

longitudinally folding the web to form the inner envelope flap adjacent the flap adhesion;

longitudinally folding the web in a web region not occupied by the inner envelope to form the insert portion;

longitudinally folding said web to form an outer envelope panel; and longitudinally folding said outer envelope web region to form the outer envelope and outer envelope flap, said outer envelope flap being free of an adhesive, which outer envelope encloses the inner envelope and the insert portion; and periodically transversely cutting the web to form the individual mailing envelope assemblies.

13. A method of making a mailing envelope assembly composed of an inner envelope and an insert portion contained in an outer envelope comprising:

conveying a web of material;

longitudinally folding said web to define a longitudinal web region from which the inner envelope is formed;

applying adhesive material transversely to a surface of said web at spaced transverse intervals in a location for the inner envelope portion;

longitudinally folding said web so that said adhesive material attaches the web at the spaced intervals to form the inner envelope portion;

applying adhesive material longitudinally on the surface of said web for an inner envelope flap adhesion;

longitudinally folding the web to form the inner envelope flap adjacent the flap adhesion;

longitudinally folding the web in a web region not occupied by the inner envelope to form the insert portion;

longitudinally folding said web to form an outer envelope panel;

applying adhesive longitudinally on a region of the web that will form the outer envelope flap;

longitudinally folding said outer envelope web region to form the outer envelope and outer envelope flap in a web region not occupied by the inner envelope and the insert portion, which outer envelope encloses an inner portion and an outer portion of the inner envelope and an inner portion and an outer portion of the insert portion, the outer envelope having been folded to have an interior portion having an inner longitudinal length and an inner transverse width, the insert portion having been folded to have a longitudinal length as contained in the outer envelope that is greater than the interior longitudinal length of said inner envelope and the longitudinal length of the insert portion as contained in the outer envelope being no greater than twice the interior transverse width of the inner envelope and the insert portion having a transverse width as contained in the outer envelope that is no greater than the longitudinal length of the interior portion of the inner envelope, so that when the form is transversely folded in half and rotated 90° relative to the orientation of the form as contained in the outer envelope, the folded insert portion fits within the interior portion of the inner envelope; and periodically transversely cutting the web to form the individual mailing envelope assemblies.

14. The method of claim 13 further comprising, prior to said longitudinally folding the web to form an outer envelope panel, forming a line of weakening longitudinally on said web adjacent said transversely applied adhesive material to allow subsequent separation of said inner envelope from a non-inner envelope portion of the assembly.

15. The method of claim 14 wherein said line of weakening is a line of perforations.

16. The method of claim 13 further comprising, prior to said longitudinally folding the outer envelope region, forming a line of weakening longitudinally on said web adjacent said panel.

17. The method of claim 14 wherein said line of weakening is a line of perforations.

18. The method of claim 13 wherein adhesive material is applied to a surface of the outer envelope flap.

19. The method of claim 18 wherein the adhesive material is pressure-sensitive adhesive.

20. The method of claim 13 wherein the adhesive material applied transversely on the surface of the web at spaced intervals in a location for the inner envelope portion is envelope spine glue.

21. The method of claim 13 wherein the adhesive material applied longitudinally on the surface of the web for the inner envelope flap adhesion is remoistenable adhesive.

22. The method of claim 13 wherein the insert is a survey form that includes instructions for a recipient to complete.

* * * * *